US006107966A

United States Patent [19]

Fahlberg

[11] Patent Number: 6,107,966

[45] Date of Patent: Aug. 22, 2000

[54] ANTENNA DEVICE

[75] Inventor: Göran Fahlberg, Kalmar, Sweden

[73] Assignee: Moteco AB, Ruda, Sweden

[21] Appl. No.: 09/068,502

[22] PCT Filed: Nov. 26, 1996

[86] PCT No.: PCT/SE96/01549

§ 371 Date: May 12, 1998

§ 102(e) Date: May 12, 1998

[87] PCT Pub. No.: WO97/20360

PCT Pub. Date: Jun. 5, 1997

[30] Foreign Application Priority Data

Nov. 28, 1995 [SE] Sweden ..... 9504262
Nov. 28, 1995 [SE] Sweden ..... 9504263

[51] Int. Cl.[7] ..... H01Q 1/24

[52] U.S. Cl. ..... 343/702; 343/725; 343/895; 343/901

[58] Field of Search ..... 343/702, 895, 343/900, 901, 725, 729; H01Q 1/24

[56] References Cited

U.S. PATENT DOCUMENTS

| | | | |
|---|---|---|---|
| 2,982,964 | 5/1961 | Bresk et al. | 343/895 |
| 4,068,238 | 1/1978 | Acker | 343/895 |
| 5,216,436 | 6/1993 | Hall et al. | 343/895 |
| 5,317,325 | 5/1994 | Bottomley | 343/702 |
| 5,710,567 | 1/1998 | Funke | 343/702 |
| 5,825,330 | 10/1998 | Na et al. | 343/702 |
| 5,861,859 | 1/1999 | Kanayama et al. | 343/895 |

*Primary Examiner*—Don Wong
*Assistant Examiner*—Shih-Chao Chen
*Attorney, Agent, or Firm*—Smith Gambrell & Russell, LLP

[57] ABSTRACT

An antenna device for a radio communication apparatus. The antenna device includes a rod antenna and a helical antenna, both of which are connectable to a transceiver. The helical antenna has an active state for receiving an emitting electromagnetic energy, and a passive state. The helical antenna is transferable from the active state to the passive state by axial compression. Preferably, the helical antenna is axially compressed into the passive state when the rod antenna is moved to an active position.

23 Claims, 6 Drawing Sheets

ANTENNA DEVICE

TECHNICAL FIELD

The present invention relates to a radio communication apparatus operating in the range of between 800 and 3000 MHz and comprising a rod antenna and a helical antenna which are connectable to a transceiver, the helical antenna having an active state for receiving and transmitting electromagnetic energy, and a passive state.

BACKGROUND ART

In radio communication apparatuses of the above-intimated type, in daily parlance known as mobile telephones, use is often made of two different antenna elements, one for the standby function and one in active use of the telephone during talks. The antenna which is employed during the standby state is often a so-called helical antenna since such an antenna is small and compact in physical dimensions. The helical antenna may be designed both as a quarter wave antenna and as a half wave antenna. On the other hand, the antenna element which is employed during talks may be physically considerably larger, since, during the standby period, it can often be retracted into the apparatus, collapsed or folded down along the longitudinal side of the apparatus, and so on.

The antenna which is employed during the standby period of the apparatus need not perform as well as the antenna which is employed during talks. Different alternatives for connecting the two antenna elements to the transceiver of the apparatus have been applied. Regardless of how the connection takes place, a certain interaction between the two antenna elements cannot be discounted. This implies not only an extremely complicated dimensioning, but also a reduction of the degree of efficiency.

PROBLEM STRUCTURE

The present invention has for its object to realise an antenna device of the type intimated by way of introduction, this antenna device being designed in such a manner that the helical antenna may be brought to a passive state in which it exercises slight or no effect on the rod antenna. The present invention further has for its object to design the antenna device such that it is simple and economical to manufacture but nevertheless performs well.

The objects forming the basis of the present invention will be attained if the antenna device intimated by way of introduction is characterized in that the helical antenna is transferable from the active to the passive state by axial compression.

Further advantages will be attained according to the present invention if the subject matter of the present invention is also given one or more of the characterizing features as set forth in appended claims 2 to 13.

BRIEF DESCRIPTION OF THE ACCOMPANYING DRAWINGS

The present invention will now be described in greater detail hereinbelow, by means of a number of embodiments which are shown in the accompanying Drawings. In the accompanying Drawings.

DESCRIPTION OF PREFERRED EMBODIMENTS

Figure 2:
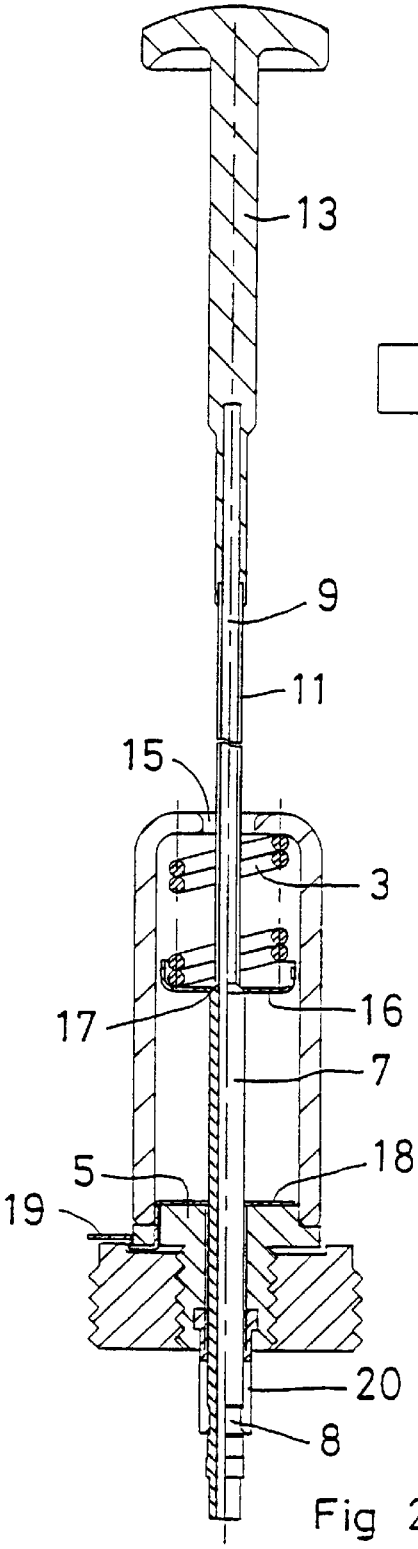
FIG. 2 shows the antenna device of FIG. 1 with the helical antenna in the passive state.

It generally applies according to the present invention that a helical antenna of the type under consideration here is a helical spiral of resilient metal wire which is matched to the frequency at which the transceiver is intended to operate. The helical antenna may be designed as a half wave antenna, but is normally designed as a quarter wave antenna. Connected at one end, the quarter wave antenna displays an impedance vis-à-vis the transceiver of approximately 50 ohms, for which reason an adaptation circuit between the helical antenna and the transceiver is not generally necessary.

A helical antenna may also have a certain conicity, such that the diameter at one end of the helix is greater than at the other end.

A helical antenna according to the above description is in an active state of use when, coupled to a transmitter, it radiates energy, or when it functions as receiver antenna.

If a helical antenna of the above described type is to be brought to a non-active state, where it no longer functions as an antenna, this is realised in the most general form of the present invention in that the helical antenna is quite simply deformed such that its axial length is reduced. This implies that its set frequency increases so that, with increased compression, increased mismatch to the transceiver is the result. Preferably, the helix is pressed or drawn together in the axial direction so far that, in the passive state, it no longer forms a helical antenna. Taken to the extreme, it might be said that the helical antenna has ceased to exist.

In the compressed or retracted state, the helical antenna is of an axial length which is considerably shorter than in the active state of the antenna. The compressed or retracted helical antenna may, in such instance, be likened to a ring, a short sleeve or a spiral of very slight pitch. In the embodiment in which the helical antenna is conical, it may, in the compressed state, be in the form of a substantially planar disk or planar spiral. Possibly, it may also be in the form of an extremely obtuse cone. Preferably, the axial deformation is so great that the individual wire coils of the helix abut against one another. However, it should be emphasised that even a minor compression of the helical antenna may be sufficient, when, in this case, such a great mismatch has been achieved that the antenna no longer functions.

In the passive state, the compression of the helical antenna may be so complete that its coils, on condition that they consist of uninsulated wire, may wholly or partly be in galvanic contact with one another.

Painted or insulated wires may also be employed in the helical antenna. In this case, no galvanic contact will be established between the individual coils in the passive state of the antenna, regardless of how compressed together it is.

Given that the helical antenna in the non-active state "does not exist as an antenna", it is, in many practical applications, immaterial whether it is galvanically or otherwise connected to or discrete from the transceiver.

In those cases where the helical antenna is designed as a half wave antenna, there is the risk that, on partial compression, it might "erroneously" become mismatched so that it functions as a quarter wave antenna. It is, therefore, safest if (in this case) it is substantially completely compressed in the passive state.

Figure 1:
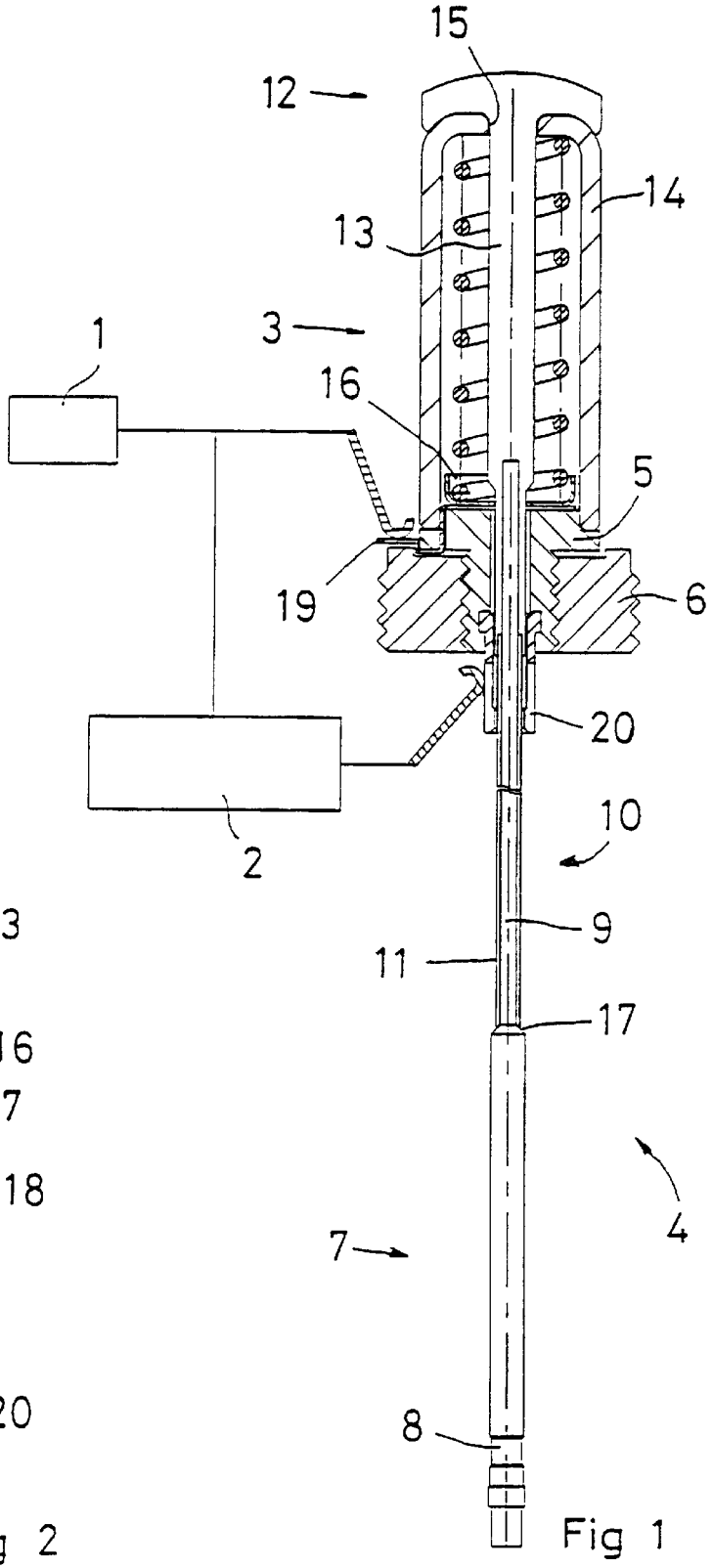
FIG. 1 shows a first embodiment of an antenna device according to the present invention, in a state in which the helical antenna is active.
Figure 11:
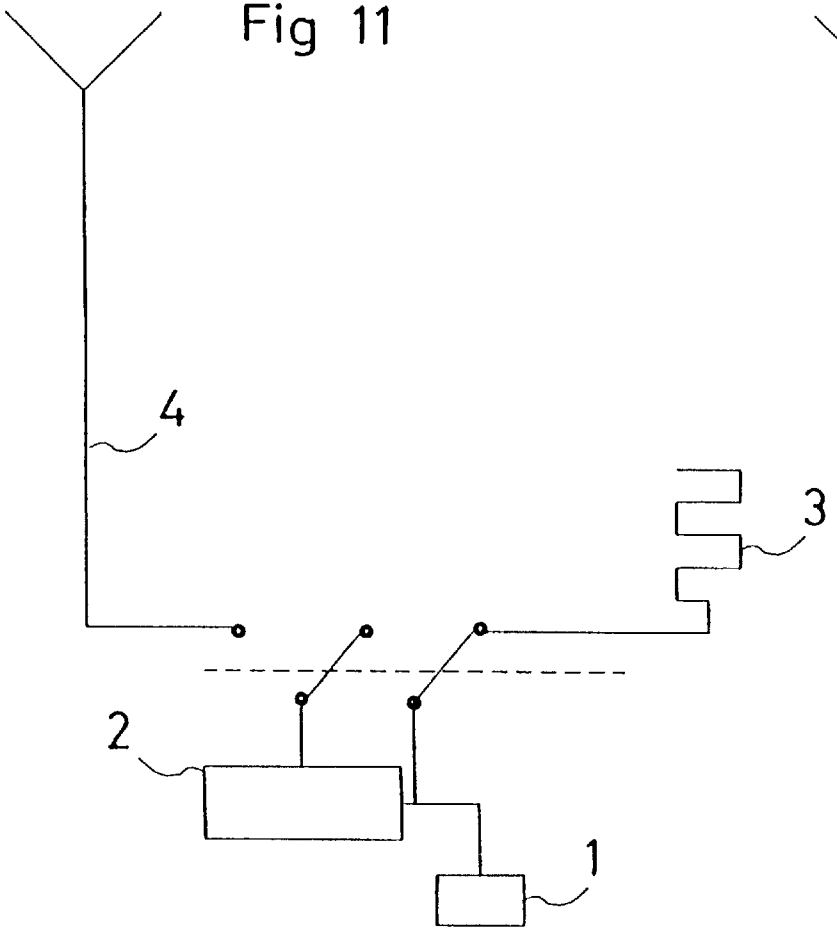
FIG. 11 is a coupling diagram showing the function of the antenna devices according to FIGS. 1–9.

In FIGS. 1 and 11, reference numeral 1 relates to a transceiver, reference numeral 2 relates to an adaptation circuit, and reference numeral 3 to a helical antenna, while reference numeral 4 relates to a rod antenna.

The rod antenna 4 is axially displaceable through a support member 5 which is produced from electrically insulating material and is secured in an apparatus casing 6. The support member, which serves for journalling the rod antenna when this is displaced axially, is in the form of a bushing or nipple.

The rod antenna 4 has a lower, relatively thick portion 7 with a circumferential groove 8 in its lower end. The bottom of the groove is in galvanic contact with a longitudinal conductor 9 in the rod antenna 4. The rod antenna has further an upper portion 10, where there is disposed an insulating layer 11 outside the conductor 9. At the upper end of the conductor 9, there is provided a button 12 of electrically insulating and non-magnetic material. The purpose of the button is to function as gripping portion on protraction and retraction of the antenna from the position illustrated in FIG. 1 to the position illustrated in FIG. 2, and vice versa. The button 12 has an extension portion 13 which is coaxial with the remaining parts of the rod antenna 4. The extension portion is produced from an electrically insulating and non-magnetic material and is of a length which is at least as great as that of the helical antenna 3 when this is in its active state. In this state, the extension portion 13 is located concentrically internally in the helical antenna.

The helical antenna 3 is disposed interiorly in a hood 14 which is manufactured from an electrically insulating and non-magnetic material. The hood has an upper end portion with an aperture 15 through which the rod antenna 4 extends in the protracted position.

Furthermore, the extension portion 13 extends in through the aperture 15 in the retracted position of the rod antenna 4. The helical antenna 3 is in the form of a helical spiral which, with its upper end, abuts against the upper end surface of the hood 14. The helical antenna is manufactured from a resilient metal wire. The lower end of the helical antenna abuts against a contact washer 16 made of metal, this washer being in galvanic contact with the helical antenna 3. The contact washer 16 has a central aperture through which the rod antenna 4 is partly slidable.

The dimensioning of the aperture in the contact washer 16 in relation to the rod antenna 4 is such that the upper portion 10 of the rod antenna may freely pass through the aperture, while, on the other hand, the lower and slightly thicker portion 7 of the rod antenna cannot pass. On protraction of the rod antenna, an abutment 17 in the transitional region between the lower and upper regions of the rod antenna will, therefore, come into abutment against the underside of the contact washer 16. As a result, on continued protraction of the rod antenna, the abutment 17 will lift the contact washer 16 so that the helical antenna 3 is hereby compressed together in the axial direction. FIG. 2 shows the helical antenna in the compressed state and, according to the Figure, the compression is so powerful that the individual coils of the helical antenna abut against one another. In this state, the helical antenna has "ceased to exist" as an antenna.

It is not necessary to compress the helical antenna 3 so far that the individual coils abut against one another, it being sufficient to shorten it so much that, by a mismatch in relation to the transceiver, it no longer functions within the frequency range in which the transceiver operates. Also in this case, the helical antenna may be considered to have "ceased to exist". Under any circumstances, the helical antenna is, in the compressed state, passive so that it is no longer capable of receiving or radiating electromagnetic energy.

On the upper side of the support member 5, there is disposed a first contact device 18 in the form of a metal washer which has a connecting portion 19 which extends to the outside of the hood 14.

The connecting portion 19 is galvanically directly connected to the transceiver 1. In the active state of the helical antenna 3, the contact washer 16 abuts against the contact device 18 so that galvanic connection is obtained between the helical antenna and the connecting portion 19 and thereby also direct to the transceiver.

If the abutment 17 on the rod antenna 4 is designed in such a manner that no galvanic contact occurs between the rod antenna 4 and the contact washer 16 when this has been lifted up on protraction of the rod antenna, the helical antenna 3 will be galvanically separated from the transceiver when it is transferred to its passive state. This is apparent from FIG. 11.

If, on the other hand, the abutment 17 is designed in such a manner that galvanic contact is formed between the contact washer 16 and the abutment 17 on protraction thereof, the helical antenna 3 will, in its passive state, be galvanically connected to the transceiver via the adaptation circuit 2. This connection alternative is not apparent from the Drawings.

In the lower end of the support member 5, there is disposed a metal sleeve which has downwardly directed contact fingers 20. The sleeve with the contact fingers 20 is galvanically connected to the adaptation circuit 2 and, via this circuit, also to the transceiver 1. On protraction of the rod antenna, the contact fingers 20 will slide at least along the thicker portion 7 of the rod antenna in order to snap into the groove 8 and there establish galvanic contact with the rod antenna.

In the above-described embodiment with the helical antenna 3 designed as a quarter wave antenna and the rod antenna 4 designed as a half wave antenna, the following dimensions may be employed:

| Helical antenna | |
|---|---|
| Number of coils | 7 |
| Pitch | 2.55 m/coil |

-continued

| | |
|---|---|
| Wire diameter | 0.4 mm |
| Outer diameter | 5.6 mm |
| Rod antenna | |
| Total length incl. button 12 | 133.6 mm |
| Length, lower, thick portion 7 | 25.8 mm |
| Diameter, lower, thick portion 7 | 2.8 mm |
| Length, upper, thin portion 10 | 74.2 mm |
| Diameter, upper, thin portion 10 | 1.2 mm |
| Length, extension portion 13 of button | 19.0 mm |

A second embodiment of the present invention is shown in FIGS. 4–9. This embodiment differs from the embodiment according to FIGS. 1–3 principally in that the adaptation circuit is integrated in the antenna. Those parts which are common to both of the embodiments will, therefore, not be described again.

The adaptation circuit is disposed on a washer produced from insulating material, the washer being designed as a small circuit card with a coil 21 on the upper side (see FIG. 9), and with an earthed plate 22 (see FIG. 6) on the underside. The circuit card 23 with the adaptation circuit is placed on the upper side of the support member 5 and has a central aperture for allowing passage of the rod antenna 4. This implies that the rod antenna 4 is axially reciprocal in the same manner as that described with reference to FIGS. 1–3. Correspondingly, the abutment 17 of the rod antenna 4 will, on protraction of the rod antenna, also lift the contact washer 16 so that the helical antenna 3 is thereby compressed in the axial direction. In this embodiment, the contact washer 16 is of slightly modified appearance.

Figure 5:
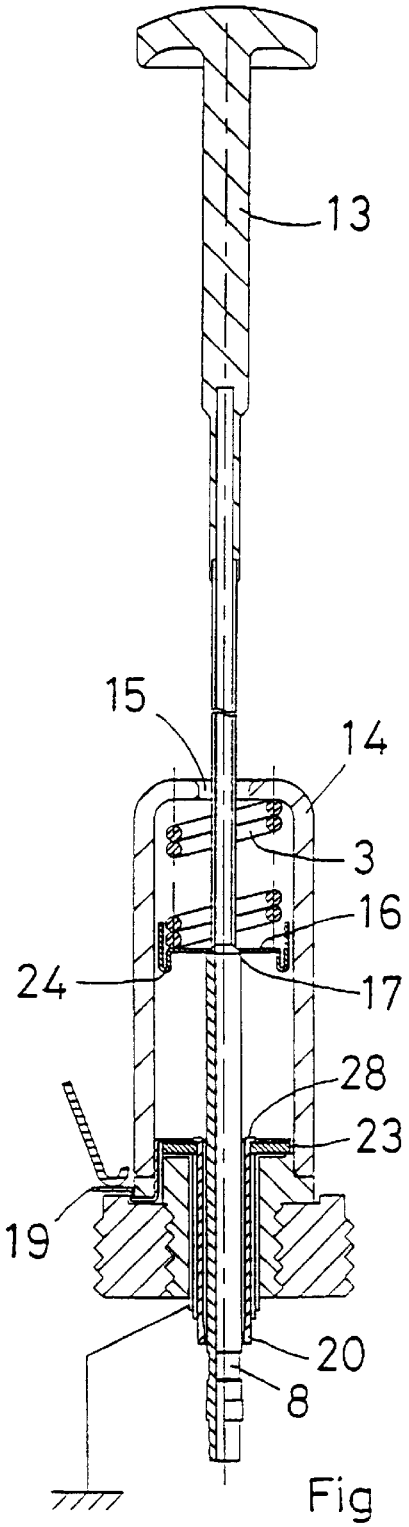
FIG. 5 shows the antenna device of FIG. 4, but with the helical antenna shown in the passive state.
Figure 4:
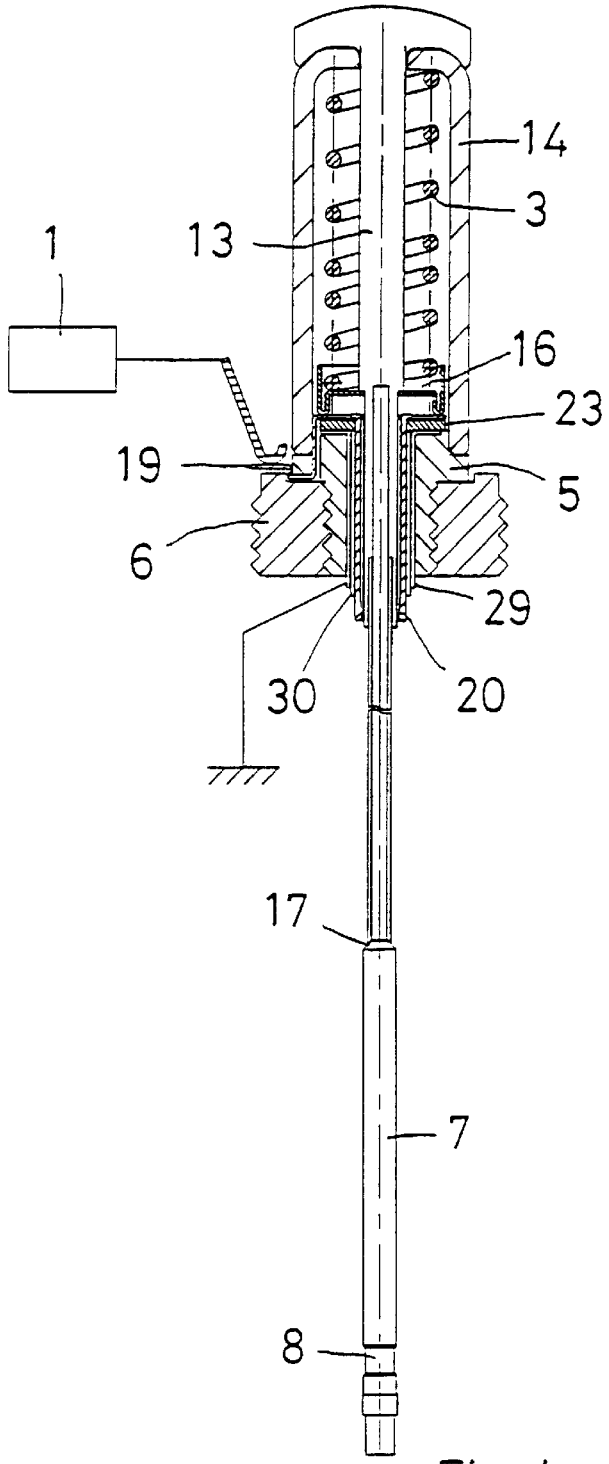
FIG. 4 shows a second embodiment of the antenna device according to the present invention, the helical antenna being in the active state.
Figure 6:
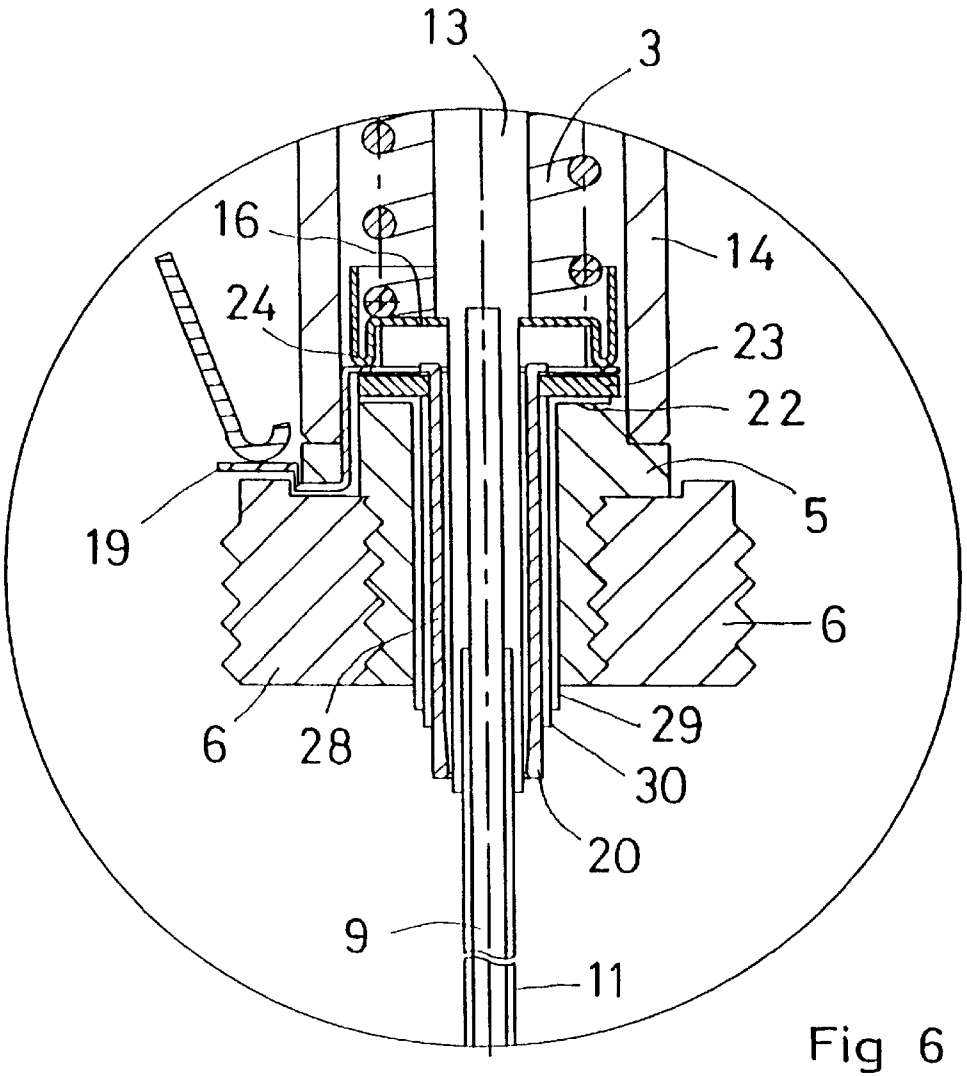
FIG. 6 is an enlarged view of the lower region of the helical antenna according to FIG. 4.
Figure 7:
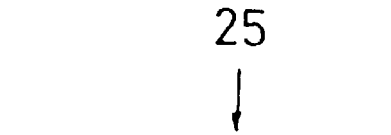
FIGS. 7–9 show details included in the antenna device according to FIGS. 4–6.
Figure 8:
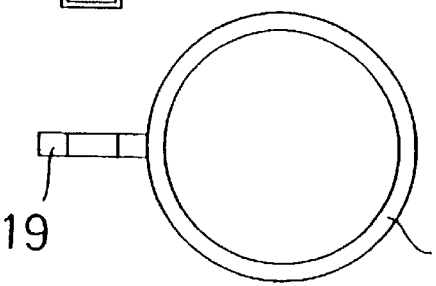
Figure 9:
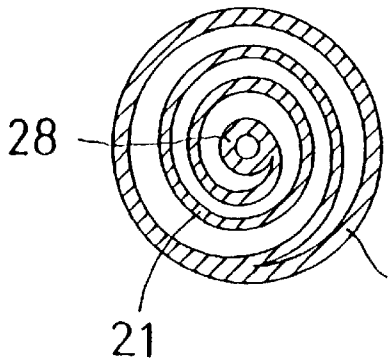

As will most readily be apparent from FIGS. 5 and 6, the contact washer 16 has, along its periphery, a downwardly directed annular portion 24 which, in the radial direction, is located in register with a narrow, peripheral band along the outer edge of the circuit card 23. On the upper side of the circu card 23, there is disposed a contact portion 25 (see FIGS. 7 and 8) which has a metal ring 26 which is galvanically connected to a connecting portion 19. Furthermore, the circuit card 23 has an outer, annular contact 27 on which the ring 26 of the contact portion 25 rests and with which it makes galvanic contact. The coil 21 is, with its outer end, connected to the annular contact 27.

The connecting portion 19 is in galvanic communication with the transceiver 1 and therefore connects the outer end of the coil 21 to the transceiver. Furthermore, the downwardly directed portion 24 of the contact washer 16 will abut against the ring 26 and establish galvanic contact with it. This entails that the helical antenna 3 has galvanic contact with the transceiver via the contact washer 16 and its downwardly directed portion 24, via the ring 26 and the connecting portion 19. In the compressed state of the helical antenna 3, the galvanic contact between the downwardly directed portion 24 of the contact washer and the ring 26 has ceased, for which reason the helical antenna is galvanically discrete from the transceiver in this state.

The inner end of the coil 21 is connected to a metal sleeve 28 which has contact fingers 20 in its lower end. The purpose of the contact fingers 20 is to snap into the groove 8 of the rod antenna 4 and establish galvanic contact with the rod antenna in its protracted state. The foregoing disclosure entails that the rod antenna is, via the fingers 20 and the sleeve 28, connectable to the inner end of the coil 21

As was mentioned above, there is disposed on the underside of the circuit card 23, an electrically conductive plate 22. This plate is earthed via a sleeve 29 of electrically conductive material. Between the sleeve 29 and the sleeve 28, there is provided an insulation sleeve 30 so that no galvanic contact occurs between the plate 22 and the contact fingers 20.

The electric coupling diagram for the antenna device according to FIGS. 4–9 is shown in FIG. 11

Figure 10:
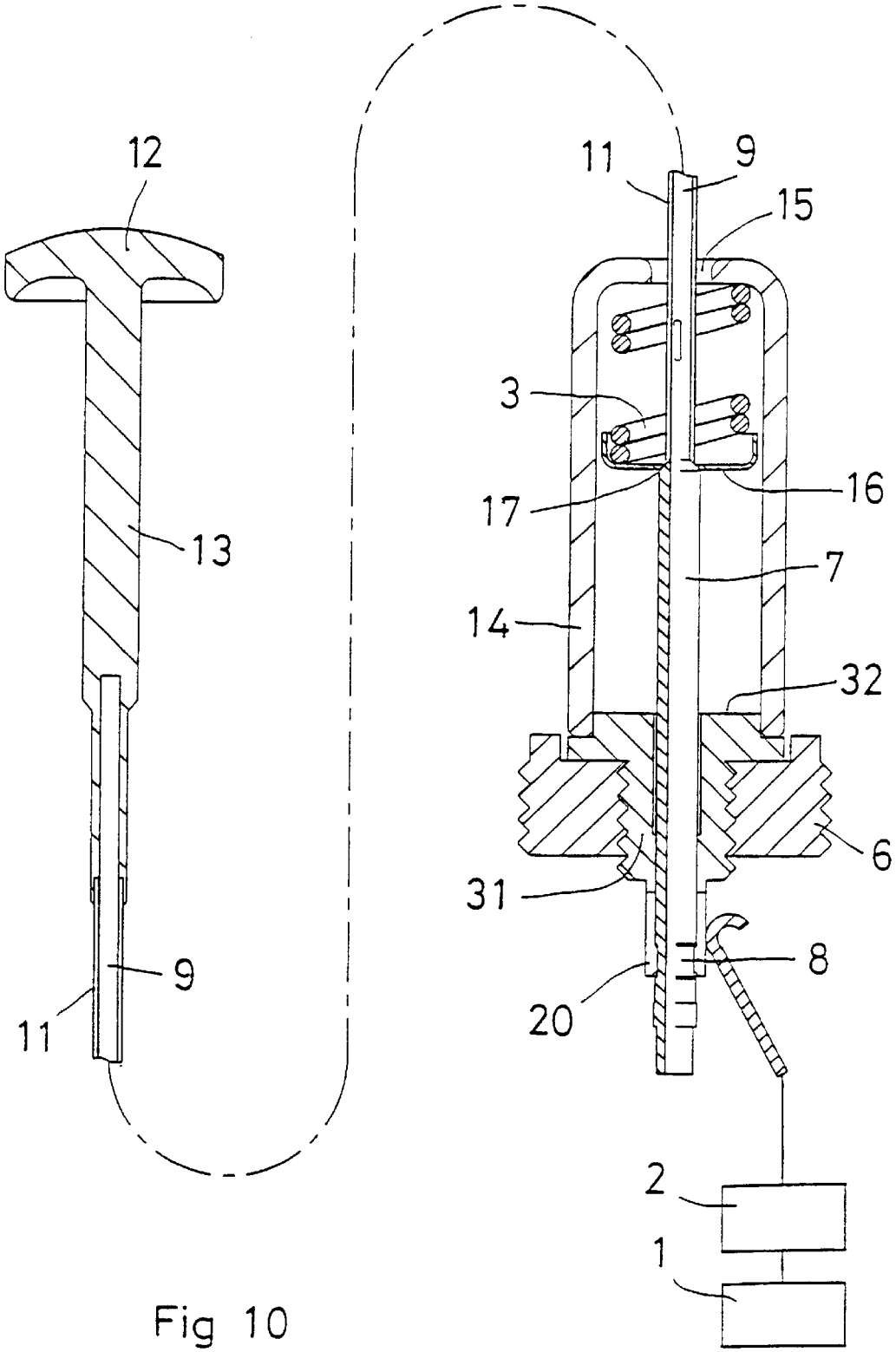
FIG. 10 shows a third embodiment of the antenna device according to the invention, the helical antenna being in the passive state.
Figure 12:
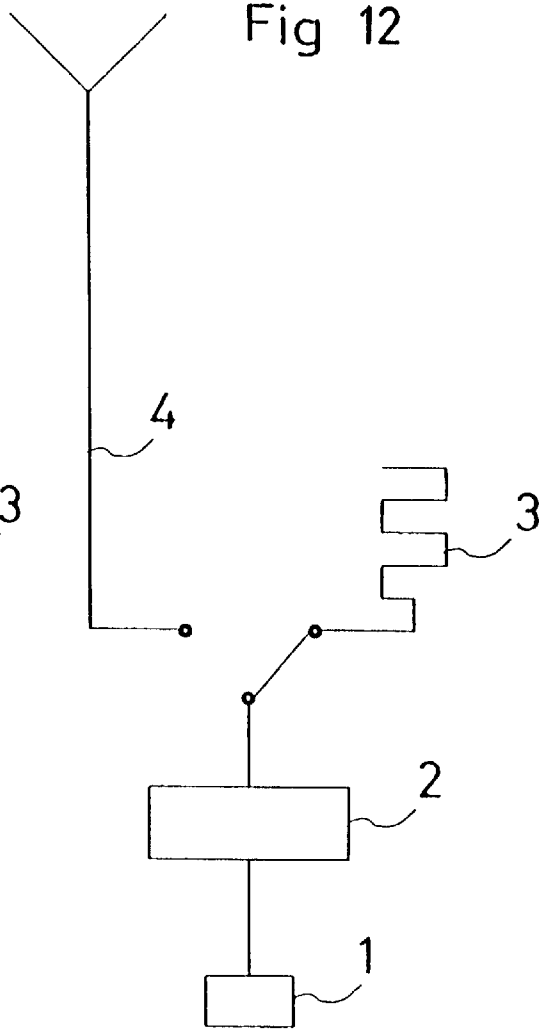
FIG. 12 is a coupling diagram showing the function of the antenna device according to FIG. 10.

FIG. 10 shows a third embodiment of the subject matter of the present invention. The electric coupling diagram for this embodiment is shown in FIG. 12.

In the embodiment according to FIG. 10, the support member is designed as a contact portion 31 of electrically conductive material. The contact portion has, in its lower end, contact fingers 20 which, in the protracted state of the rod antenna 4, snap into the groove 8 of the rod antenna and establish galvanic contact with the rod antenna. The contact portion 31 or its contact fingers 20 are connected to an adaptation circuit 2 which, in turn, is connected to the transceiver 1.

Figure 3:
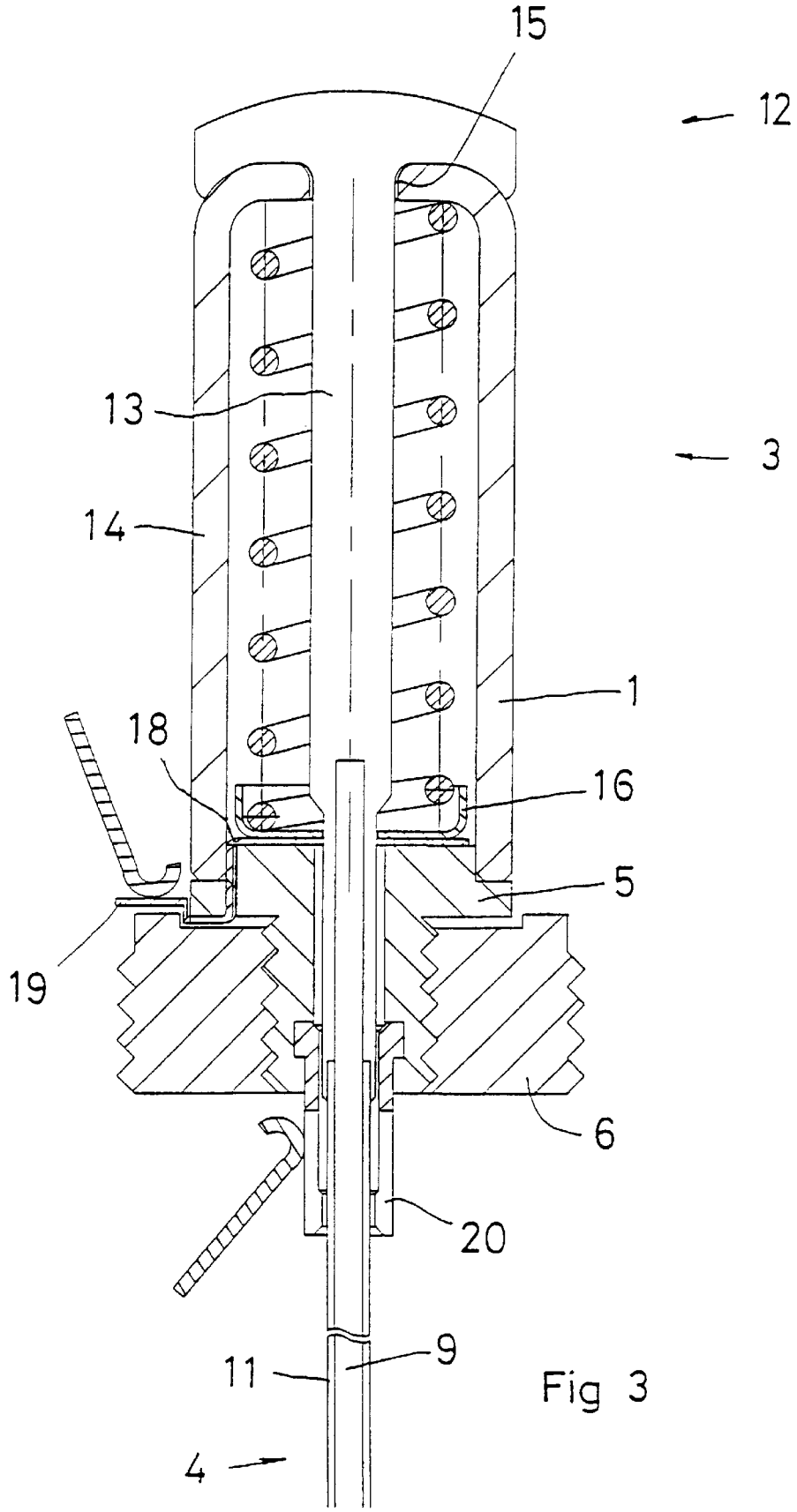
FIG. 3 is an enlarged view of the upper part of FIG. 1.

Given that the support member is designed as a contact portion and is manufactured from an electrically conductive material, it has, on its upper side, a contact surface 32 which is intended to cooperate with the contact washer 16 in the same manner as the contact device 18 according to FIG. 3. In the active state of the helical antenna 3, the contact washer 16 abuts against the contact surface 32 and establishes galvanic contact therewith, for which reason the helical antenna is galvanically connected to the adaptation circuit 2 and, via this circuit, also the transceiver.

With the helical antenna 3 designed as a quarter wave antenna, the connection of the adaptation circuit 2 implies that the helical antenna will become mismatched, which is nevertheless no worse than the helical antenna still possesses sufficient performance to function during standby periods.

The present invention may be modified further without departing from the spirit and scope of the appended Claims.

What is claimed is:

1. An antenna device, comprising:

a hood, a rod antenna movably extending through the hood, and a helical antenna disposed in the hood, wherein the helical antenna extends in an axial direction and is transferable from an active state, for receiving and transmitting electromagnetic energy, to a passive state by compressing the helical antenna in the axial direction.

2. The antenna device as claimed in claim 1, wherein the rod antenna is transferable between an active position, for receiving and emitting electromagnetic energy, and a passive position by displacement, and wherein the antenna device further includes mutually cooperating engagement means for compressing the helical antenna in the axial direction to the passive state when the rod antenna is displaced to the active position, and for allowing the helical antenna to decompress in the axial direction to the active state when the rod antenna is displaced to the passive position.

3. The antenna device as claimed in claim 2, wherein the rod antenna is disposed substantially coaxially within the helical antenna; and the rod antenna is transferable between the active position and the passive position by axial displacement.

4. The antenna device as claimed in claim 2, wherein the mutually cooperating engagement means includes:

a contact washer formed from conductive material, the contact washer abutting against a first end of the helical antenna such that the helical antenna is galvanically connected to the contact washer, the contact washer defining a central aperture through which the rod antenna is displaceable, and an abutment formed on the rod antenna, the aperture and the abutment being mutually dimensioned such that, upon displacement of the rod antenna to the active position, the abutment contacts and moves the contact washer, whereby the helical antenna is compressed in the axial direction.

5. The antenna device as claimed in claim 4, wherein the hood is made of electrically insulating and non-magnetic material, the hood having an end surface which abuts a second end of the helical antenna opposite the first end, the end surface defining an aperture through which the rod antenna is displaceable.

6. The antenna device as claimed in claim 3, wherein the rod antenna has a top with a button formed of electrically insulating and non-magnetic material, the button having an extension portion with a length that is at least as great as a length of the helical antenna when the helical antenna is decompressed in the axial direction to the active state, the extension portion being located inside of the helical antenna when the helical antenna is in the active state.

7. The antenna device as claimed in claim 4, further including:

a support member through which the rod antenna is axially displaceable, and a first contact device for connecting the helical antenna to a transceiver, the first contact device being disposed at a first side of the support member facing towards the helical antenna such that the first contact device is galvanically connected to the contact washer when the helical antenna is in the active state.

8. The antenna device as claimed in claim 7, further including:

an insulating washer formed from an insulating material, an adaptation circuit formed on the insulating washer and galvanically connected to the first contact device, and a second contact device that galvanically connects the rod antenna to the adaptation circuit when the rod antenna is displaced to the active position.

9. The antenna device as claimed in claim 8, wherein the insulating washer is disposed between the support member and the first contact device, and the insulating washer defines a central aperture through which the rod antenna is displacable.

10. The antenna device as claimed in claim 4, further including a contact portion formed of electrically conductive material for galvanically connecting the helical antenna to a transceiver, the contact portion defining an aperture through which the rod antenna is axially displaceable, and having a contact surface which abuts against the contact washer when the helical antenna is in the active state.

11. The antenna device as claimed in claim 1, wherein coils of the helical antenna are slightly spaced apart in relation to one another when the helical antenna is in the passive state, such that the helical antenna forms a spiral with a slight pitch.

12. The antenna device as claimed in claim 1, wherein the helical antenna is permanently galvanically connected to a transceiver.

13. The antenna device as claimed in claim 1, wherein the helical antenna is galvanically connected to a transceiver in the active state, and is galvanically discrete from the transceiver in the passive state.

14. The antenna device as claimed in claim 4, wherein the abutment is conductive and galvanically connected to the rod antenna, such that the helical antenna is galvanically connected to the rod antenna when the helical antenna is compressed in the axial direction to the passive state.

15. The antenna device as claimed in claim 4, wherein the abutment is insulative, such that the helical antenna and contact washer are galvanically isolated when the helical antenna is compressed in the axial direction to the passive state.

16. The antenna device as claimed in claim 7, further including a second contact device that galvanically connects the rod antenna to the adaptation circuit when the rod antenna is displaced to the active position.

17. The antenna device as claimed in claim 1, wherein the rod antenna is a half wave antenna and the helical antenna is a quarter wave antenna; and wherein the antenna device further includes an adaptation circuit for connecting the rod antenna to a transceiver.

18. The antenna device as claimed in claim 2, wherein the rod antenna is a half wave antenna and the helical antenna is a quarter wave antenna; and wherein the antenna device further includes an adaptation circuit for connecting the rod antenna to a transceiver.

19. The antenna device as claimed in claim 1, wherein the helical antenna has a conical shape, such that the helical antenna forms a planar disk in the active state.

20. The antenna device as claimed in claim 2, wherein the helical antenna has a conical shape, such that the helical antenna forms a planar disk in the active state.

21. An antenna device for a radio communication apparatus having at least one transceiver and operating in the range of 800 MHz to 3000 MHz, the antenna device comprising:

a rod antenna, wherein the rod antenna is transferable by longitudinal displacement between an active position, for receiving and emitting electromagnetic energy, and a passive position;

a helical antenna having an active state in connection with the transceiver, for receiving and transmitting electromagnetic energy, and a passive state;

first engagement means on the helical antenna for moving the helical antenna from the active state to the passive state; and second engagement means on the rod antenna for abutting the first engagement means to transfer the helical antenna to the passive state and to disconnect the helical antenna from the transceiver when displacing the rod antenna to its active position.

22. An antenna device as claimed in claim 21, wherein the first engagement means includes a contact washer produced from conductive material, the contact washer abutting against one end of the helical antenna and being electrically connected thereto, the contact washer having a central aperture through which the rod antenna is displaceable; and the second engagement means includes an abutment formed from a non-conductive material and positioned on the rod antenna so that the contact washer is electrically insulated from the rod antenna, the abutment being arranged to compress the helical antenna in an axial direction of the helical antenna when the rod antenna is extended toward the active position.

23. The antenna device as claimed in claim 22, further including:

a support member through which the rod antenna is axially displaceable; and a contact device for connecting the helical antenna to a transceiver, the contact device being disposed at a first side of the support member facing towards the helical antenna such that the contact device is galvanically connected to the contact washer when the helical antenna is in the active state.

* * * * *